United States Patent [19]

Foreman

[11] Patent Number: 4,909,106

[45] Date of Patent: Mar. 20, 1990

[54] RATCHET WRENCH

[76] Inventor: William E. Foreman, 907 Mason Dr., Blacksburg, Va. 24060

[21] Appl. No.: 295,736

[22] Filed: Jan. 11, 1989

[51] Int. Cl.[4] ..... B25B 13/46

[52] U.S. Cl. ..... 81/60; 81/58.5

[58] Field of Search ..... 81/58, 58.5, 59.1, 60, 81/63.1

[56] References Cited

U.S. PATENT DOCUMENTS

| | | | |
|---|---|---|---|
| 572,857 | 12/1896 | Barnes | 81/58.5 |
| 926,653 | 6/1909 | Hampton | 81/58.5 |
| 964,100 | 7/1910 | Garpheide et al. | 81/60 X |
| 978,395 | 12/1910 | Peters | 81/58.5 |
| 1,101,022 | 6/1914 | Goodwin | 81/58.5 X |

*Primary Examiner*—D. S. Meislin

*Attorney, Agent, or Firm*—Richard C. Litman

[57] ABSTRACT

A ratchet wrench including an elongated handle having one end provided with a retainer, and a socket member attached to the handle's one end by means of a loop of high strength, flexible material such as carbon fibers, metal wire or the like, the loop extending around the retainer and socket member. Normally the socket member is freely rotatable and when the handle is manipulated for tightening or loosening a nut, the flexibility of the loop material permits relative movement between the handle and socket member to produce an interlocking of the handle's one end and the socket member for operation of the wrench, the interlocking action being produced with various arrangements such as engagement between peripheral teeth on the socket member and the edges of the handle's one end, a wedging action by a ball between the socket member and an arcuate depression in the retainer or simply elevating or depressing the handle to produce a frictional gripping engagement between the surfaces on the handle's one end and the socket member.

10 Claims, 2 Drawing Sheets

RATCHET WRENCH

FIELD OF THE INVENTION

This invention relates generally to hand tools and more particularly to a wrench of the type referred to as a ratchet wrench commonly used by mechanics and the like to apply or remove threaded nuts and the like on threaded members.

BACKGROUND OF THE INVENTION

One of the most basic tools which has been in use since tools were first developed is the wrench, which is a vital component of any collection of tools for mechanics and the like. A type of wrench which any mechanic will always have available is the ratchet wrench, by means of which a mechanic may rapidly and quickly accomplish either the attachment or removal of a nut on a threaded member or, install or remove a threaded bolt having a polygonal head. As is well-known, through a series of reciprocating motions of the wrench handle a ratchet wrench permits a nut to be quickly applied or removed. In the years of development of such ratchet wrenches the focus has been to increase the simplicity of such tools, the use of lightweight materials, durability and ease of use. A lightweight, low-cost, durable tool has always been the objective so as to reduce the time and effort required to perform the task for which a ratchet wrench is suitable.

DESCRIPTION OF THE RELATED ART

As an example of a prior art ratchet wrench, reference is made to U.S. Pat. No. 572,857 dated Dec. 8, 1896 to Barnes which relates to such a wrench having a socket member provided with teeth and swingably supported on a pair of arms for engagement by the end of the wrench handle during operation. Other ratchet wrenches will be found in U.S. Pat. No. 926,653 dated June 29, 1909 to Hampton and U.S. Pat. No. 978,395 dated Dec. 13, 1910 to Peters. None of the above patents suggest the unique construction and adaptability of the present invention.

SUMMARY AND OBJECTS OF THE INVENTION

By the present invention, an improved ratchet wrench is provided which is readily adapted to a variety of embodiments for accomplishing the same objective. The ratchet wrench of the invention includes a handle and a socket member connected thereto by a flexible strap formed from a high strength material such as carbon fibers, metal wire and the like which retains the socket member in close association with the adjacent end of the handle for free rotation normally. In one embodiment of the invention, the socket member is provided with circumferentially extending teeth which are engaged by an edge on the forward end of the handle upon limited relative movement between the handle and socket member, such relative movement between the handle and the socket member being permitted by the flexibility of the strap. Preferably, two overlying sets of toothed surfaces are provided on the socket member which are engaged respectively by opposite edges of the forward end of the handle so that the ratchet wrench may be operated in either direction by simply reversing the position of the socket member on the nut.

In another embodiment of the invention the socket member is provided with a circumferentially extending groove, and the forward end of the handle is provided with an arcuate recess forming with the groove a clearance space in which a wedging ball is positioned. Normally, the ball is freely movable in the clearance space but movement of the handle in either a clockwise direction in one position of the wrench or in a counterclockwise direction in an inverted position of the wrench moves the ball into wedging engagement between the socket member groove and the arcuate recess locking the handle and socket together, thereby permitting operation of the ratchet wrench.

In a third embodiment of the invention the peripheral surface of the socket member, which may be provided with a friction-increasing surface, and the forward end of the handle are frictionally locked together by elevating or depressing the handle so that the forward end of the handle releasably grips the peripheral surface of the socket member, as permitted by the flexible strap.

Thus, the ratchet wrench of the invention lends itself to a plurality of embodiments, all of which utilize only a few component parts and one of such embodiments permits the wrench to be readily manipulated for a nut-tightening or loosening operation without removal of the wrench from the nut with which the wrench is engaged. The wrench of the invention does not require the provision of any additional parts for reversing the wrenching operation, which can be accomplished by simply inverting the wrench in two of the embodiments. In those embodiments in which the wrench is inverted for operation in the opposite direction no manipulating of parts is required and the durability of the component parts of the subject wrench insures prolonged use even under maximum forces without risk of breakdown. As a result of the simplicity of construction of the wrench of the invention, the size of the wrench is substantially less than that of corresponding conventional wrenches so that less space is required in a mechanic's tool box. Furthermore its light weight makes the use of the wrench easier and faster. In addition, in one embodiment, the wrench of the invention may be used with its handle at an angle, thereby increasing its ease of operation. An outstanding feature of the invention is the use of a flexible strap of a high tensile strength material which is not only flexible and virtually wear-resistant but is stronger than steel by weight, and which should exceed the useful life of the other parts of the wrench.

Accordingly a primary object of the invention is to provide a new and novel ratchet wrench which may be used when mounted on a nut to rotate the nut in either direction, without the provision of any supplemental parts.

Another object of the invention is to provide a new and novel ratchet wrench in which the socket member is attached to the wrench handle by a flexible member of extremely high strength to impart an advantageous degree of flexibility to the wrench and in which the durability of the flexible member is greater than that of the metal parts of the wrench.

Still another object of the invention is to provide a new and novel ratchet wrench which is adapted to be constructed in a variety of forms and which is characterized by a high degree of flexibility so that the handle may be positioned at a selected angle during the operation of the wrench.

A still further object of the invention is to provide a new and novel ratchet wrench which is simple and inexpensive in construction, which is lightweight and compact and in which the component parts may be easily replaced in the event of damage or breakdown.

With these and other objects in view which will more readily appear as the nature of the invention is better understood, the present invention resides in the novel construction, combination and assembly hereinafter more fully illustrated, described and claimed, with reference being made to the accompanying drawings wherein the same reference characters are applied to the same or corresponding parts in the various illustrations.

DESCRIPTION OF THE PREFERRED EMBODIMENTS

Figure 1:
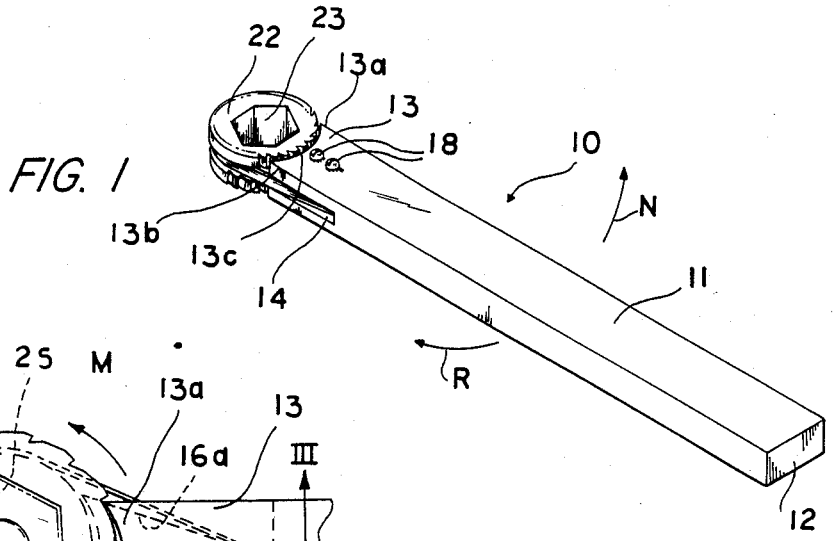
FIG. 1 is a perspective view of a primary embodiment of the ratchet wrench of the invention showing the parts in an inoperative condition.

Referring now to the drawings and to FIG. 1 in particular, there is shown one embodiment of the wrench of the invention which is designated generally by the reference numeral 10. The ratchet wrench 10 includes an elongated handle 11 having a rear end 12 and a forward end 13 having an arcuately shaped end edge **13*c* defining oppositely disposed side edge portions 13*a*, 13*b*. The portion of the handle 11 adjacent the end 13 is provided with a forwardly opening longitudinal slot 14 which extends a selected depth within the handle 11 towards the rear end 12**.

The slot 14 is arranged to accommodate a retainer 16 preferably somewhat triangular in shape having a side edge **16*a* and an arcuate forward edge 17. The retainer 16 is secured within the slot 14 by means of a pair of longitudinally spaced screws 18 or the like extending through suitable apertures in the retainer 16 for threaded engagement with tapered recesses 19 in the handle 11**.

The ratchet wrench 10 also includes a socket member 22 having a nut-receiving central opening 23 which, as is well-known, may be hexagonal in shape as shown, and adapted to accommodate a nut 25. It will be noted that when the retainer 16 is positioned within the slot 14, the retainer forward edge 17 extends slightly forward of the handle forward edge **13*c* for guiding engagement with the socket member 22** as will be explained hereinafter.

Figure 2:
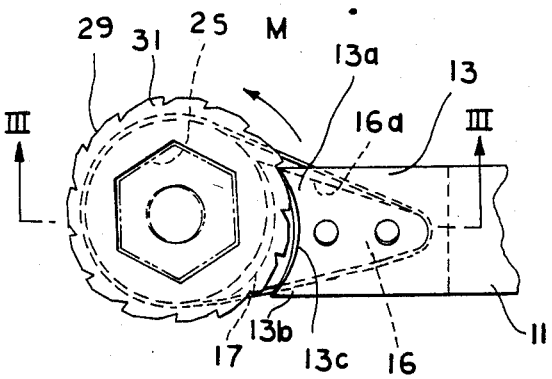
FIG. 2 is an enlarged plan view of a portion of the ratchet wrench of FIG. 1 showing the parts in an operative condition.
Figure 3:
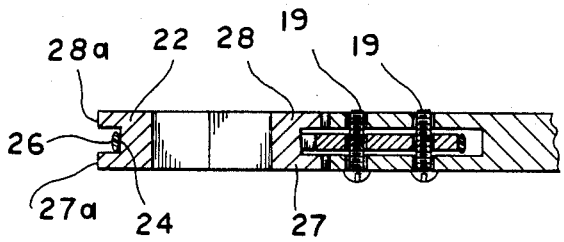
FIG. 3 is a sectional view taken substantially along line III—III of FIG. 2 in the direction of the arrows.

As shown best in FIG. 3, the socket member 22 is of generally cylindrical shape and includes a central necked-down portion 24 forming a circumferentially extending groove 26. Thus, the portion 24 defines a pair of plates 27, 28 of enlarged diameter arranged in vertically spaced relationship and having peripheral sidewalls **27*a*, 28*a* respectively. The peripheral sidewalls 27*a*, 28*a* of each of the plates 27, 28 respectively are provided with a set of circumferentially extending notches 29 forming teeth 31 of the type found in conventional ratchet wrenches. It will be noted that the teeth 31 on both plates 27, 28 extend in the same direction which, in the embodiment shown, is clockwise as viewed in FIG. 2**.

Means are provided for attaching the socket member 22 to the handle 10 and for yieldingly retaining the socket member in engagement with the handle end 13. With this arrangement, the socket member 22 is freely rotatable on the handle 11 in the inoperative condition of the wrench 10.

More specifically, the socket member 22 is mounted on the front end 13 of the handle 11 by a strap 32 of flexible material which, in the present invention, is formed of flexible material of high strength such as carbon fibers, Spectra 1000 (a trademark of Allied Corp.), metal wire or the like. In the illustrated embodiment, the strap 32 is preferably in the form of a loop extending around the socket member 22 within the groove 26 and around the side edges **16*a* of the retainer 16 through the handle slot 14 as shown. Thus, when there is no load on the wrench 10 the socket member 22 is freely rotatable on the handle 11 with the front edge 17 of the retainer 16, shaped arcuately so as to correspond to the arcuate shape of the portion 24, extending within the socket member groove 26** in guiding engagement therewith.

As can be seen in FIG. 1, the edge portions **13*a*, 13*b* of the handle 11 are normally maintained out of engagement with the teeth 31 on the socket member 22 so that free rotation of the socket member 22 is permitted. During use, when a nut 25 is inserted within the nut-receiving opening 23 of the socket member 22, limited relative movement between the handle 11 and the socket member 22 is initiated by rotating the handle relative to the socket member 22 as indicated by the arrow N in FIG. 1 so that the edge portion 13*a* of the handle front end 13 engages within a selected notch 29 as shown in FIG. 2, thereby releasably locking the handle to the socket member for driving engagement with the associated tooth 31. The socket member 22** may then be rotated in the direction of the arrow M to the desired degree by further rotation of the handle in the same direction as indicated by the arrow N.

For a reverse operation of the wrench 10, the wrench is inverted from the position of FIG. 1 to the position as shown in FIG. 3 so that the teeth 31 on the plate 28 are on top and the teeth 31 extend in a counterclockwise direction. After placing the socket member 22 on the nut 25, the handle 11 is then rotated to a limited extent in the direction of the arrow R for engagement of the handle edge portion **13*b* within a selected notch 29. Further movement of the handle 11 in the direction of the arrow R permits the ratcheting operation to be performed. As can be understood, a movement of the handle 11 in the opposite directions from that of the arrows N, R in the respective positions permits the angular edge 13*c* of the handle end 13 to slide freely over teeth 31, and there is no engagement between edge portions 13*a*, 13*b* of the handle 11 and the teeth 31. All of the aforementioned operations are permitted by the flexibility of the strap 32**.

Figure 4:
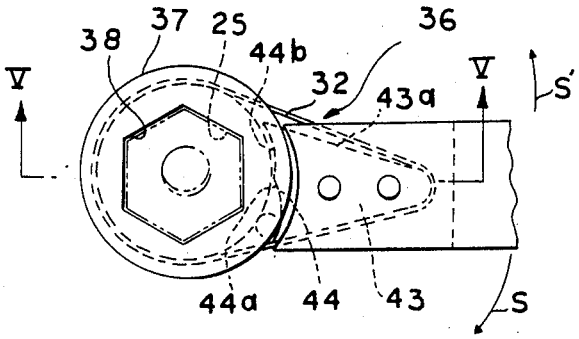
FIG. 4 is a plan view similar to FIG. 2 of a second embodiment of the ratchet wrench of the invention showing the parts in an inoperative condition.
Figure 5:
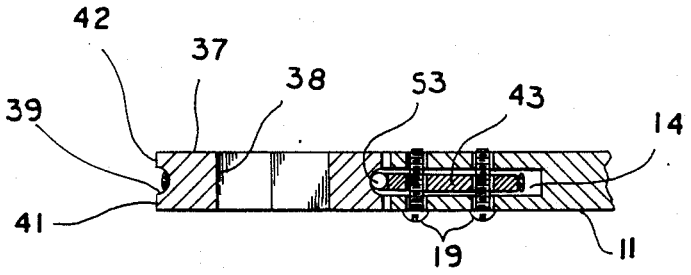
FIG. 5 is a sectional view taken substantially along line V-V of FIG. 4 in the direction of the arrows with the wrench in a position inverted from that of FIG. 4.

Referring now to FIG. 5 wherein like numerals are used to identify like parts, there is shown a portion of a second embodiment of the ratchet wrench of the invention which is identified generally by the reference numeral 36. In FIG. 5, a socket member 37 is provided which is cylindrical in shape having a nut-receiving opening 38, the socket member 37 being provided with an annular groove 39 between upper and lower plates 41, 42. A retainer 43 is provided as in the embodiment of FIG. 1, but of different construction, having a side edge 43*a* and a forward edge 44 provided with an arcuate depression 44*a* extending throughout a portion of the forward edge 44 as shown best in FIG. 4. Preferably, the retainer edge 44 also includes a further arcuate depression 44b conforming generally to the arcuate shape of the groove 39.

The strap 32 extends within the socket member groove 39 and around the side edge 43*a* of the retainer 43 which is disposed within the slot 14 of the handle 11 and held therein by means of screws 19 as in the previous embodiment.

In the embodiment of FIG. 5, the arrangement for releasably locking the normally freely rotatable socket member 37 to the handle end 13 includes the provision of the arcuate depression 44a on the forward end of the retainer 43 which defines with the groove 39 on the socket member 22 a wedging cavity. A spherical member or ball 53 is disposed in this wedging cavity between the groove 39 and the arcuate depression 44*a* of the retainer 43. In the normal inoperative position of the wrench 36, the ball 53 floats freely between these surfaces so that free rotation of the socket member 37 is permitted. When the wrench is operated, with a nut within the nut-receiving opening 38 of the socket member 37, a limited relative movement between the handle 11 and socket member 37 in the direction of the arrow S wedges the ball 53 within the narrow portion of the wedging cavity between the depression 44*a* and the groove 39. Thereafter, the handle and socket member rotate together when the handle is further rotated in the direction of the arrow S to perform the ratcheting operation. With the rotation of the handle 11 in the opposite direction as indicated by the arrow S' in FIG. 4, there is no wedging action and the handle moves freely on the socket member 37.

To rotate the nut 25 in the opposite direction, the wrench 36 is inverted as shown in FIG. 5, and placed on the nut 25 whereby the same locking and ratcheting operation is accomplished when the handle 11 is rotated in opposite directions to that of the arrows S, S'.

Figure 6:
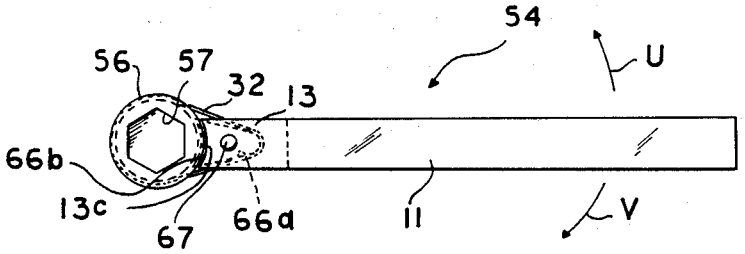
FIG. 6 is a plan view of a third embodiment of the ratchet wrench of the invention showing the wrench in an inoperative condition.
Figure 7:
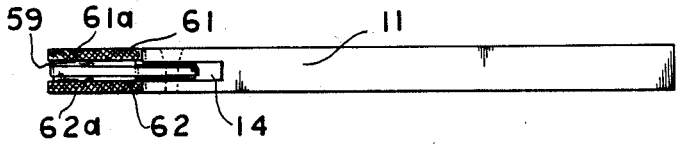
FIG. 7 is a side view of the ratchet wrench of FIG. 6.

Referring now to FIG. 6, there is shown a third embodiment of the invention wherein like numerals are used to identify like parts and wherein the wrench is identified generally by the reference numeral 54. The wrench 54 includes a handle 11 having a forward end 13 provided with an arcuate forward edge 13*a*. The ratchet wrench 54 also includes a socket member 56 having a nut-receiving opening 57 and includes an annular groove 58 formed by a necked-down portion 59 defining a pair of upper and lower plates 61, 52. The peripheral surfaces 61*a* and 62*a* of the plates 61, 62, respectively, are preferably provided with a friction-producing surface such as by knurling or the like. As in the previous embodiments, a strap 32 is also provided which extends within the groove 58 of the socket member 56 and around the side surface 66*a* of a retainer 66 disposed within the handle slot 14. Retainer 66 is held within the slot 14, as in the previous embodiments, by means of at least one screw 67. The retainer 66 includes an arcuate forward edge 66*b* which abuts against the sidewall of the socket member portion 59 so that the socket member 56 is positioned and held against the handle end 13 for free rotation normally by means of the strap 32.

Figure 8:
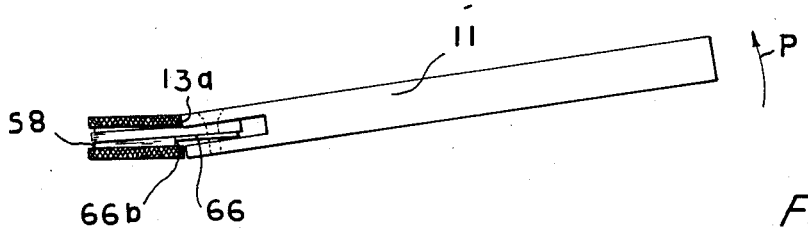
FIG. 8 is a view similar to FIG. 7 showing the wrench in an operative condition.

In the operation of the ratchet wrench 54, when it is desired to tighten or loosen a nut disposed within the opening 57 of the socket member 56, the handle 11 is raised as shown for instance by the raising of the handle in the direction of the arrow P in FIG. 8, so that the arcuate forward edge 13*a* of the handle end 13 engages the knurled surface 61*a*, thereby producing a frictional grip on the socket member 56 and releasably locking the socket member 56 and handle 11 together. The handle may then be turned in the desired lateral direction, depending on the direction the nut is to be turned, thereby performing a tightening or loosening action on the nut. This vertical angular movement of the handle 11 is permitted, as explained above, as a result of the flexibility of the strap 32. It should be noted that the handle 11 may be moved angularly downward for a similar engagement of the handle end edge 13*a* with the knurled surface 61*b*, whereby the same nut-tightening or loosening operation may be performed.

It should also be noted that in the embodiment of FIG. 6, a nut may be turned in either direction without removing the socket member 56 of the wrench 54 from the nut.

What is claimed is:

1. A ratchet wrench comprising, in combination, a socket member, an elongated handle, flexible means for rotatably supporting said socket member on one end of said handle to permit limited relative movement between said handle and said socket member, a releasable locking means operatively attached to said handle one end and said socket member responsive to said limited relative movement for releasably locking said handle one end to said socket member for rotation of said socket member with said handle, said flexible means includes a strap of flexible material and means for connecting said strap to said socket member and said handle one end, said strap is formed as a loop of said flexible material and wherein said connecting means includes said socket member of cylindrical shape having an outer surface provided with a circumferentially extending groove, said strap being disposed within said groove, said handle includes a slot disposed in said handle one end and wherein said connecting means includes a retainer plate fixedly mounted in said slot for retaining engagement with said strap extending through said slot and extending beyond said handle one end into engagement with said groove.

2. A ratchet wrench is accordance with claim 1 wherein said releasable locking means includes a first set of circumferentially extending teeth on said socket member outer surface extending in one direction and including a first forwardly extending edge portion on said handle one end for driving engagement with a selected one of said teeth during said limited relative movement in one direction of movement of said handle.

3. A ratchet wrench in accordance with claim 2 including a second set of circumferentially extending teeth on said socket member outer surface in vertically spaced relationship with said first set of circumferentially extending teeth extending in said one direction of said first set of teeth and including a second forwardly extending edge portion on said handle one end oppositely disposed from said first forwardly extending edge portion for driving engagement with a selective one of said teeth on said second set of teeth in an inverted position of said socket member during said limited relative movement and in the opposite direction of movement of said handle.

4. A ratchet wrench in accordance with claim 1 wherein said means for releasably locking said handle one end to said socket member comprises wedging means in operative engagement with said retainer plate and said socket member, said wedging means is for wedging between said socket member and said retainer plate to prevent rotation in one direction in order to lock said handle and said socket member together for concomitant rotation.

5. A ratchet wrench in accordance with claim 4 wherein said wedging means is for wedging between said socket member and said retainer plate to prevent rotation in the opposite direction when in an inverted position of said wrench in order to lock said handle and socket member together for concomitant rotation.

6. A ratchet wrench in accordance with claim 4 wherein said wedging means includes a forward end of said retainer plate adjacent said socket member provided with an arcuate depression inserted into and defining with said groove on said socket member a wedging cavity, a normally, freely movable spherical member in said wedging cavity, said spherical member being movable in wedging engagement with said groove and said retainer plate arcuate depression during said relative movement of said handle in said one direction.

7. A ratchet wrench in accordance with claim 1 wherein said releasable locking means includes at least one portion of increased diameter on said socket member having a peripheral sidewall and wherein said handle one end is provided with an arcuate end face corresponding to said peripheral sidewall, said handle arcuate end face being movable into frictional gripping engagement with said peripheral sidewall during a vertical angular movement of said handle relative to said socket member in one direction.

8. A ratchet wrench in accordance with claim 7 wherein said peripheral sidewall is provided with a friction-increasing surface.

9. A ratchet wrench in accordance with claim 7 including two portions of increased diameter on said socket member having peripheral walls arranged in vertically spaced relationship on opposite sides of said groove, said handle one end has two arcuate end faces corresponding to said peripheral sidewalls and each said end face being movable into said frictional gripping engagement with one of said peripheral sidewalls on a selected one of said portions of increased diameter during said vertical angular movement of said handle in said one direction or in an opposite direction respectively.

10. A ratchet wrench in accordance with claim 9 wherein said peripheral sidewall on said two portions of increased diameter is provided with a friction-increasing surface.

* * * * *